US005208998A

United States Patent [19]

Oyler, Jr.

[11] Patent Number: 5,208,998

[45] Date of Patent: May 11, 1993

[54] LIQUID SUBSTANCES FREEZE-DRYING SYSTEMS AND METHODS

[76] Inventor: James R. Oyler, Jr., 2801 Ocean Dr., Vero Beach, Fla. 32963

[21] Appl. No.: 770,456

[22] Filed: Oct. 3, 1991

Related U.S. Application Data

[63] Continuation-in-part of Ser. No. 659,727, Feb. 25, 1991, abandoned.

[51] Int. Cl.[5] ..... F26B 5/06

[52] U.S. Cl. ..... 34/5; 34/92; 159/4.01

[58] Field of Search ..... 34/5, 92, 15, 17, 60, 34/57 R, 35, 86; 159/4.01, DIG. 5

[56] References Cited

U.S. PATENT DOCUMENTS

Re. 24,469 5/1958 Reinert ..... 34/5
1,976,204 10/1934 Voorhees et al. ..... 34/5
2,507,632 5/1950 Hickman ..... 34/5
3,210,861 10/1965 Eolkin ..... 34/5
3,290,788 12/1966 Seelandt ..... 34/5

*Primary Examiner*—Henry A. Bennet
*Assistant Examiner*—Denise Gromada
*Attorney, Agent, or Firm*—Carroll F. Palmer

[57] ABSTRACT

Spray-freeze-drying systems and methods are disclosed for converting a wide variety of liquid substances into dry powder that may be reconstituted into the original substance by addition of water or other liquid that had been removed therefrom. Such systems and methods involve repetitive cycles of four operational steps, i.e., freezing, drying, defrosting and resetting and are characterized by: spraying the liquid substance downwardly in a vessel while surrounding the spray with a downward flow of process gas during the freezing step and by utilizing a heat pump for energy recapture to increase efficiency of operation.

27 Claims, 4 Drawing Sheets

LIQUID SUBSTANCES FREEZE-DRYING SYSTEMS AND METHODS

REFERENCE TO RELATED APPLICATION

This application is a continuation-in-part of copending application Ser. No. 07/659,727, filed Feb. 25, 1991, now abandoned.

BACKGROUND OF THE INVENTION

1. Field of the Invention

This application relates to improved freeze-drying systems and methods. More particularly, it concerns such systems and methods whereby a wide variety of liquid substances may be dried at lower cost and with higher quality than previously possible.

2. Description of the Prior Art

Two drying techniques related to the present invention are spray-drying and freeze-drying. Spray-drying requires that the product to be dried is a liquid or can be made into a liquid which is sprayed through a nozzle under pressure to produce a mist or stream of fine droplets. These fine particles are exposed to a hot gas which evaporates the moisture almost instantaneously, leaving a dry powder which can later be reconstituted to its liquid state by addition of the original solvent (hereafter assumed to be water for purposes of discussion, but not as a limitation on the invention).

Freeze-drying is of more recent origin than spray-drying, depending, as its name implies, on technology to freeze a substance while drying it. In this type of process, the substance to be dried (which need not be a liquid) is first frozen so that the water contained in it is turned to ice. The ice is then removed by sublimation, which is the direct evaporation of the gas (water vapor) from the solid state (ice) without ever becoming liquid. When the process is complete, the original product is cold, but dry; it may then be warmed and packaged for storage. Like the spray-dried product, it can be reconstituted by the addition of water.

Freeze-drying has advantages over spray-drying for the dehydration of many substances. Thus, the low temperatures used in the process prevent deterioration of the product caused by heat. Also, some substances are sticky at the higher temperatures used in other methods of drying and cannot therefore be successfully dried without using additives or drying aids. Further, once frozen, the substance is not susceptible to deterioration during the drying process by exposure to liquid water. Additionally, freeze-dried products are very easily reconstituted by the addition of water and such process is faster and more complete than with products dried by other methods.

The result of these advantages is that the final, reconstituted product of freeze-drying is of a higher quality than can be achieved by other drying procedures. In particular, the taste and texture of reconstituted freeze-dried foods are often indistinguishable from the original, even after prolonged storage at ambient conditions.

Given these clear advantages, the question may arise why freeze-drying has not replaced other dehydration methods. The answer is that, unfortunately, freeze-drying has been typically more expensive than any of the other means of dehydration and has, therefore, been limited to high-value goods or situations where high quality and reduction of bulk are very important.

A combination of spray-drying and freeze-drying is possible. This is achieved by spraying a liquid substance into a freezing environment, and then freeze-drying the resulting accumulation of small frozen particles, which combination can be called spray-freeze-drying (SFD) (see U.S. Pat. Nos. 2,471,035; 3,300,868; 3,362,835 & 3,396,475). A particularly attractive means of drying the accumulated particles in SFD operations is by passing a gas through them in such a way as to a fluidized bed (see U.S. Pat. No. 3,313,032). However, operations disclosed in such prior art involve features that limit their commercial applicability in one or more ways, namely, (a) inefficiencies in heat and mass transfer, (b) lack of flexibility and control to allow processing of a wide variety of substances, including highly concentrated or sticky substances and (c) require system components which are difficult or expensive to fabricate or operate.

OBJECTS

A principal object of the invention is the provision of new improvements in spray-freeze-drying systems and methods.

Further objects include the provision of SFD systems and methods that:

1. Operate at ambient pressure or slightly in excess thereof thereby eliminating the need for costly vacuum systems, heavy processing vessels, etc.
2. Are substantially less expensive to construct and operate than prior known systems.
3. Operate in a highly energy efficient manner.
4. Have sufficient range and flexibility to economically process a variety of products susceptible to dehydration by spray-freeze-drying.
5. Operate at substantially lower cost than current systems and methods.
6. Produce desired drying with a substantially shorter cycle time than other methods of freeze-drying.
7. Are capable of processing normally difficult substances, such as highly concentrated or sticky products.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of improvements in systems and methods for spray-freeze-drying liquid substances, such as fruit juices, biologicals, pharmaceuticals, etc., in a single processing vessel by means of a recirculating dry gas at near-atmospheric pressure. For the purpose of illustration, reference will be made to fruit juices, and specifically to orange juice concentrate, but it is to be understood that this specific reference in no way limits the applicability of the invention to other substances which can be processed in a liquid form.

Processing takes place in a series of steps which are executed in a continuing, repetitive cycle. The steps in this cycle are: 1.) Freeze; 2.) Dry; 3.) Defrost; and 4.) Reset as illustrated by the following flow diagram:

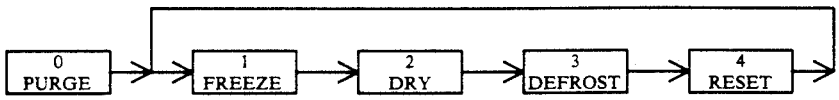

The initial step of purging the system and filling it with the processing gas is done only as needed, e.g., at initial starting.

The use of a recirculating gas allows the system to operate at near-atmospheric pressure rather than in a vacuum. Such gas serves several purposes, including, (a) freezing the sprayed liquid, (b) drying the resulting frozen particles and (c) assisting in a defrost cycle.

Preferably, the recirculating gas is nitrogen gas, though the particular gas is not a limiting factor, but could be any gas with the necessary temperature properties which also does not adversely affect the volatile or oxidizable components of the substance undergoing dehydration. The use of a gas rather than a vacuum allows significant economies in the mechanical design of all components (which do not need to withstand vacuum conditions) and also greatly improves heat transfer processes.

During the freezing step, the liquid substance which is to be spray-freeze-dried is sprayed under pressure through a nozzle, which atomizes the material into a mist or stream of fine droplets. This stream is contacted by a cold gas inside the processing vessel in such a way as to almost instantaneously freeze the stream into solid particles, which then settle to the bottom of the vessel.

Crucial to the operation of the spray-freezing step is the unique ability of the invention to independently provide and control the flow of process gas around the spray nozzle and through the bed during this step. Such capability is critical to successful operation of the system because the dynamic balance required to form the particles, freeze the spray, and maintain the bed simultaneously at their optimum points can only be achieved in this way.

During spray-freezing, the cold gas supplied by the duct and hood surrounding the spray nozzle removes both the sensible heat of the sprayed liquid and the heat of fusion as it freezes. The heat removed from the spray depends on the specific heat and the heat of fusion of the liquid, its temperature drop, and the rate of flow of the liquid through the nozzle. (The rate of flow through the nozzle is determined by the material, the desired particle size, the nozzle design, and process parameters such as batch size and spraying time.) The heat supplied by the cold process gas will depend on its specific heat, density, flow rate, and temperature rise. The final temperatures of the frozen material and process gas (which will be nearly the same) must be low enough to ensure that all particles are completely frozen and non-sticky. Only when all of these variables are in balance will the spray-freezing be effective.

Specifically, the flow rates of product and gas are mathematically related. For a given flow rate $F_P$ of product through the nozzle, the gas flow $F_G$ around the nozzle can be found by solving for $F_G$ from the following equations:

$$Q_P = Q_G$$

where $Q_P = F_P(H_{VP}\Delta T_P + H_{FP})$ $$Q_G = F_G(H_{VG})\Delta T_G$$

and

Q = heat flux (heat per unit time)

F = flow rate (volume per unit time)

$H_V$ = heat content per unit volume per degree $H_F$ = heat of fusion per unit volume $\Delta T$ = temperature change At the same time, process gas is passed through the lower plenum to create the fluidized bed. The required flow will vary over time as the bed builds up. The flow needed to fluidize the bed at the start of spraying will be small, but become larger as the bed becomes heavier. The flow through the bed must be accurately controlled or the particles will either be blown upward into the spray (and possibly out of the system) or else not lifted sufficiently to separate the particles and prevent clumping. The bed flow also has the secondary purpose of further cooling the particles in the bed to ensure that they are very cold, thereby allowing for some temperature rise during the later drying step without approaching the melting point.

During the drying step, the bed of frozen droplets at the bottom of the vessel is fluidized by passing the gas through the bed, i.e., the gas is passed upwardly through a bed of accumulated particles with a velocity relative to the base area of the bed such that the bed expands into a larger volume having a discernable upper limit without the particles becoming entrained in the fluidizing gas stream.

The fluidizing gas is dried and heated sufficiently to supply the heat of sublimation needed to remove the frozen water, but not so much as to melt the particles. The gas is dried by passing it over a cold surface, which is at a temperature sufficiently below the frozen particles so that the sublimed water vapor is condensed as snow upon the cold surface. In some embodiments, such cold surface may be within the processing vessel wherein the spray particles are fluidized, while in other embodiments, the cold surface may be external of such vessel.

After the particles have all been exposed to the drying gas for enough time to reach the desired level of product dryness, the dried material is removed from the processing vessel. Ice condenser surfaces are then defrosted to remove the accumulated snow and ice. The necessary heat is supplied by various means. The melt water is removed from the system through valves positioned for this purpose.

The system is then cooled and gas circulation initiated to reset all conditions to the level needed to begin again with the freezing step one. In this fashion, processing is carried on in a continuing repetitive cycle.

The combination of systems and methods included in the invention provide a number of advantages. The reduction of capital cost resulting from the elimination of vacuum conditions has been previously noted. In addition, the invention provides numerous and distinct advantages in operation, primarily in the areas of heat and mass transfer. Heat transfer refers to the provision of heat needed to sublime the ice in the frozen material into vapor; mass transfer refers to the removal of the sublimed vapor from the product and its vicinity.

In conventional vacuum freeze-drying, the product is most often placed on trays or platens in a vacuum chamber. Heat is supplied through the plate on which the product is supported by circulating steam or hot brine through coils attached to the platens, or sometimes electrically. If the product is originally a liquid, it is frozen in sheets on the plates; alternatively, it may be frozen in blocks, then ground or milled to produce smaller particles for placement on the trays. In addition to the extra steps required, these methods result in relatively large particles or sheets which are difficult to heat effectively. Usually, part of the material will be too hot while other parts may become too dry; utilizing a smaller temperature gradient makes the process slow and uneconomical. In addition, the dried product may need further processing to obtain a powder of uniform particles.

In such systems, mass transfer of the sublimed vapor is also difficult. Vapor is formed at the heated surface, but must exit the material at the open face away from the platen. The transit of vapor from one surface to the other may be very slow, especially if the layer is thick. Once the vapor has left the surface of the material, it is collected on large ice condensers located adjacent to the plates. Because the vapor pressure differential between the frozen material and the ice condensers is relatively small, the mechanical structure is large and structurally hard to accommodate.

The difficulties related to heat and mass transfer are especially prominent with sticky or highly concentrated products. In fact, such materials cannot effectively be freeze dried in these conventional systems.

The invention advantageously solves these problems by its unique combination of a freeze-spray step, a fluidized bed, and a processing gas at near-ambient pressures which is circulated, dried, and reheated in a continuous closed loop as previously described.

The freeze-spray cycle forms particles of small, uniform structure automatically, without need of auxiliary steps such as grinding, milling, or classifying. These small particles have a very large surface relative to their volume, so that both heat and mass transfer can approach their most favorable limit. The particles then fall into a bed, where they are fluidized by the process gas passing through them.

A fluidized bed is well known as one of the most efficient means to actually achieve the heat and mass transfer efficiency possible with small particles. The circulating gas both supports the bed and effectively contacts the enormous total surface area of the accumulated particles. Heat is supplied by the gas to the particles uniformly and with very low temperature differentials either within or between particles. Similarly, vapor has both a large surface through which to dissipate, and very short paths within the product because of the small size of the particles. Further, because the particles are supported or float in a gas stream, they do not forcibly contact each other.

The combination of small temperature gradients, easy vapor egress, and minimal particle contact means that sticky, dense, or highly concentrated materials can be dried efficiently and effectively. This ability contributes strongly to the efficiency of the invention. For example, the amount of water contained in a liquid concentrate of 25% solids (the normal limit of conventional sublimation processes) is almost six times greater than the amount of water contained in a concentrate of 65% solids (possible with the invention). In addition, at the higher concentrations the amount of solid substance is sufficient to yield a self-supporting dried matrix or particle, while the lower concentrations often require additives to provide additional support and structure in the final powder.

The processing gas also substantially improves the mechanism of vapor removal from the vicinity of the product. Unlike vacuum, the carrier gas can be pumped with inexpensive and powerful blowers, providing the motive force to transport the vapor quickly and effectively. The ice condensers to condense the vapor can then be located optimally based on cost and mechanical design factors (whether internal or external to the vessel). Through the reheat system, the dried gas then carries additional sublimation energy back to the bed.

Both the heat and cold requirements of the system are supplied from the hot and cold tanks, respectively. As will be described, these tanks are supplied by a heat pump which further improves the operating efficiency of the invention.

As an illustration of certain operational improvements achieved by the invention, the normal processing time for frozen liquids in a conventional freeze drier generally ranges between 10 and 24 hours for a single batch. During this entire time, the system must supply heat, cold, and vacuum, all at considerable expense. By comparison, the invention completes a single cycle in ½ to 3 hours, depending on batch size and the requirements of the product.

To summarize, the invention comprises a specific and tightly related combination of elements, including a circulating process gas at near-atmospheric pressure, spray-freezing directly into a stream of cold process gas, creation of a fluidized bed by the circulating gas, highly efficient heat and mass transfer, drying/reheating of the gas, and an efficient source of the needed hot and cold energy.

In practice, it is anticipated that a series of processing systems will be employed, so that each unit will be a module in a larger plant. The flow of finished product will then be almost constant, since one or more modules will be in the production step at all times, while others are being defrosted or reset.

BRIEF DESCRIPTION OF THE DRAWINGS

A more complete understanding of the invention can be obtained by reference to the accompanying drawings in which identical elements are identified by the same number and wherein.

DESCRIPTION OF THE PREFERRED EMBODIMENTS

In the following detailed discussion of the new systems and methods of the invention, specific dimensions, temperatures, and other conditions are given by way of illustration. Where these are critical they will be so identified; otherwise a range of these variables is possible and the invention encompasses embodiments according to these alternate values.

Figure 1:
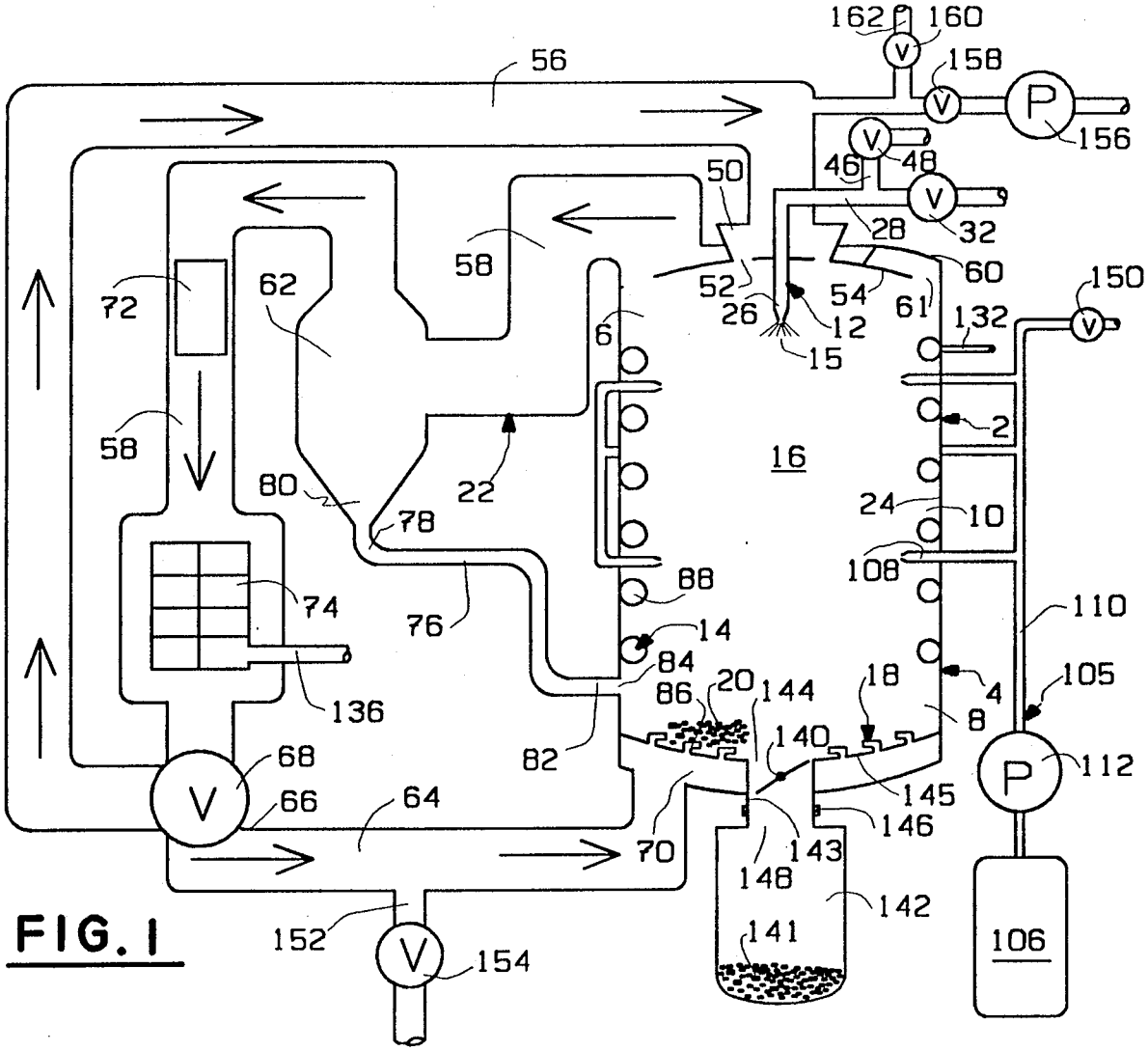
FIG. 1 is a schematic diagram of a SFD system in accordance with the present invention.
Figure 2:
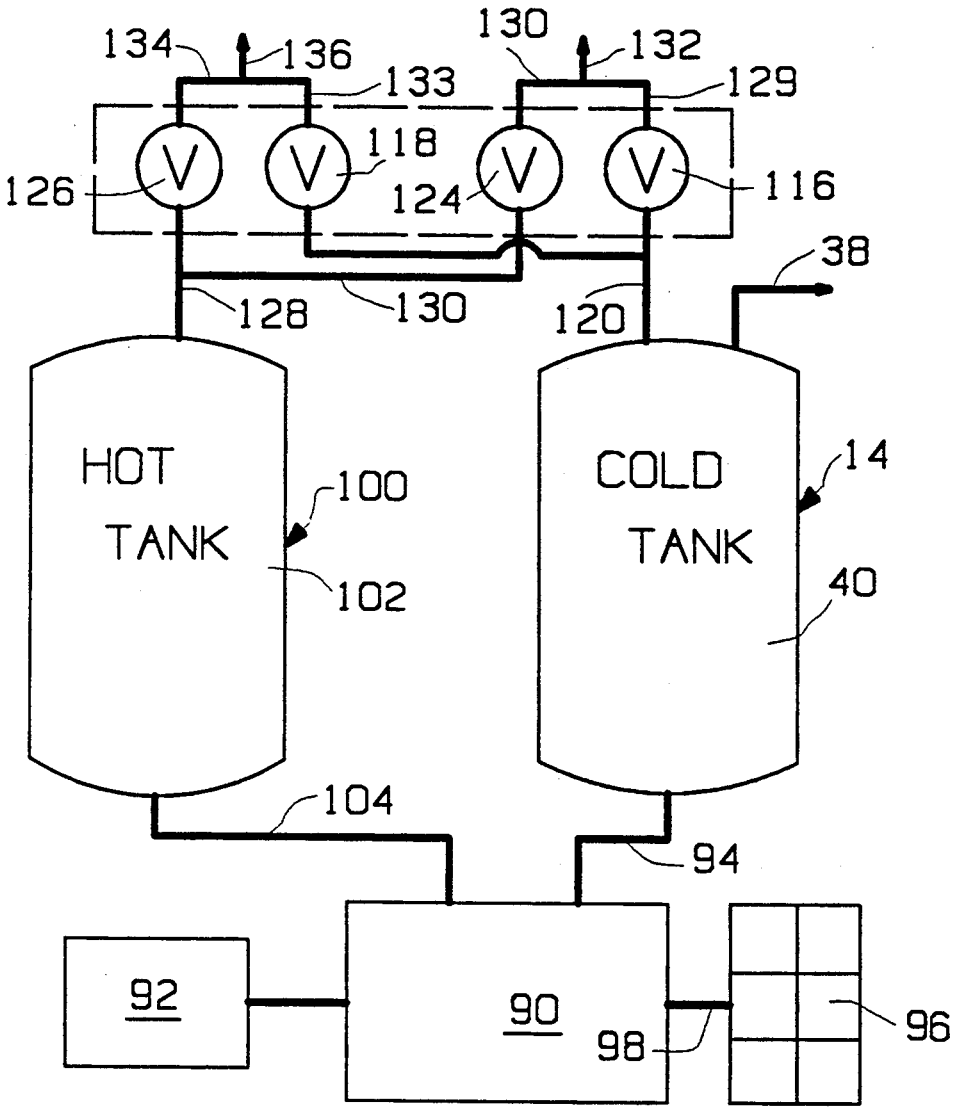
FIG. 2 is a schematic diagram of the source of heat and cold for the SFD system of FIG. 1.
Figure 3:
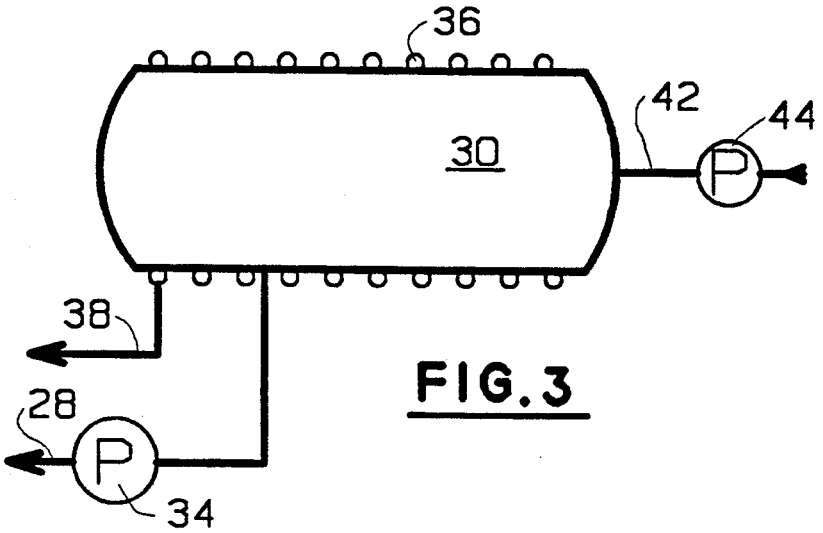
FIG. 3 is a schematic diagram of a feed material holding tank with cooling from the cold source of FIG. 2.

With special reference to FIGS. 1-3, the spray-freeze-drying system 2 for the spray-freeze-drying of a liquid substance includes a thermally insulated vessel 4 defined by a top portion 6, a bottom portion 8 and a central portion 10.

System 2 further includes atomizing means 12 to deliver atomized liquid substance 15 into the top portion 6, cooling means 14 to reduce the temperature of the interior 16 of said vessel 4 to below the freezing point of the liquid substance in spray 15, means 18 in bottom portion 8 to fluidize frozen particles 20 formed in said vessel, and gas circulation means 22 for introducing and withdrawing carrier gas into and from vessel 4.

It is to be understood that vessel 4 plus all related pipes, valves, conduits and other components of system 2 are well insulated with insulation material (not shown) to mitigate caloric transfer between system 2 and the ambient.

All processing takes place in vessel 4. This vessel is fabricated of stainless steel or other non-corrosive material to allow hygienic processing even of acidic or otherwise corrosive substances. The vessel is of sufficient mechanical strength to allow creation of a partial vacuum during the purge step. A typical size for the vessel is 5' in diameter by 8' tall, allowing a commercially attractive volume from a single module. However, the dimensions can be scaled either up or down to process larger or smaller volumes, respectively, in each cycle. The only requirement is that the proportions not reach limits that would either a.) be so narrow in cross-section that the spray from the nozzle reaches the walls 24 before freezing is complete, thus sticking to the walls; or b.) the spray 14 reaches the bottom portion 8 before freezing is complete. Advantageously, vessel 4 is of circular cross-section, but vessels of polygonal cross-section may be used.

With reference to FIGS. 1 & 3, atomizing means 12 comprises at least one spray nozzle 26 and piping 28 that connects to feed material holding tank 30 via valve 32 and pump 34.

Tank 30 is of conventional jacketed design with imbedded coils 36 that connect via piping 38 to cold tank 40 (FIG. 2). Tank 30 is supplied with raw feed material from an influent source (not shown) via line 42 and pump 44.

Piping 28 is connected by a T-line 46 and valve 48 to a source of pressurized gas (not shown) to clear the nozzle 26 after spraying.

The gas circulation means 22 comprises (1) a plenum 50, which communicates with the vessel interior 16 via openings 52 in the domed top 54 of vessel 4, (2) a first conduit 56 joined to the plenum 50, (3) a second conduit 58 that communicates with the vessel interior 16 via plenum 60 and opening 61 in the domed top wall 54 of vessel 4 and includes a cyclone separator 62 and (4) a third conduit 64 which connects at one end 66 to conduit 58 via proportioning valve 66 and at the other end to plenum 70 attached to the bottom portion 8 of vessel 4.

Located in the gas flow path of conduit 58 (indicated by arrows) is a turbine or blower 72 and heat exchanger 74. Also, there is a fourth conduit 76 which connects at one end 78 to the base 80 of cyclone separator 62 and communicates at the other end 82 with the vessel interior 16 via opening 84 so that the small amount of particles that escape from the vessel 4 will be returned to it by separator 62.

The fluidizing means 18 comprises the plenum 70 and its attached nozzles 86.

The cooling means 14 comprises (A) internal coils 88, (B) cold tank 40, (C) refrigeration unit 90, e.g., a heat pump, driven by motor 92 and connected to tank 40 via line 94, and (D) radiator 96 connected to unit 90 via line 98.

The system 2 further includes primary heating means 100 comprising hot tank 102 connected to unit 90 via line 104 (FIG. 2) and secondary heating means 105 comprising hot water heater 106 plus nozzles 108 connected to heater 106 via line 110 and pump 112.

The cooling means 14 and heating means 100 used to supply the heat and cold to the processing components are important parts of the system 2, since much of the energy efficiency of the invention derives from said means 14 & 100.

As shown in FIG. 2, the refrigeration unit 90 is configured as a heat pump operating to create a temperature differential between the cold tank 40 and the hot tank 102 with line 94 feeding from the cold side of unit 90 and line 104 feeding from the hot side of unit 90.

The tanks 40 & 100 are filled with a heat-exchanging liquid capable of maintaining desired properties at the temperatures used, e.g., approximately 30° C. in hot tank 102 and −60° C. in cold tank 40. An example of such a liquid is d-limonene, though the invention is not limited to this particular choice.

Since inefficiencies of operation may produce more heat than is required in the processing steps, the refrigeration system is also equipped with auxiliary heat exchanger 96 to remove such excess heat and prevent any possible overheating of the refrigeration components.

In operation of system 2, the head-exchange fluid from tanks 40 and 102 is pumped via a valve manifold 114 to the various components of system 2. Thus, manifold 114 comprises valves 116 and 118 connected to tank 40 via lines 120 and 122 plus valves 124 and 126 connected to tank 102 via lines 128 and 130. Also, valves 116 and 124 connect via lines 129 and 131 respectively to line 132 which feeds the coils 88 of vessel 4 while valves 118 and 126 connect via lines 133 and 134 respectively to line 136 which feeds the heat exchanger 74 in conduit 58.

The efficiency of system 2 is due to the fact that neither heat energy nor cold energy is exhausted to the outside environment, but is recovered by the heat pump via the circulating fluid. For example, in the drying step (the most energy-intensive step), hot tank 102 supplies the energy of sublimation to heat exchanger 74. The cold tank 40 simultaneously supplies the condensation energy to the internal walls 24 and coils 88 of vessel 4. As far as the state change of the water vapor is concerned, these two energies exactly balance. As can be seen, with their coupling to heat pump 90, hot tank 102 is cooled (gives up heat) while the cold tank 40 is warmed (gains heat). The temperature differential between the tanks is thereby reduced, and the heat pump 90 operates at a higher efficiency (smaller temperature differential).

Likewise, the cooling energy required in the freezing step and the heat energy needed in the defrost step approximately offset each other, providing similar efficiency gains to heat pump 90 (energy recapture) as described above. The tanks 40 and 102 effectively operate as a flywheel, storing energy and allowing recapture of otherwise wasted energy.

In addition to the foregoing effects, the unique combination of cooling means 14 and heating means 100 also achieves lower costs in further ways. Thus, the flywheel effect of the holding tanks 40 and 102 allows the entire system 2 to be sized for average requirements, rather than for the peaks. The fixed investment and installation requirements are therefore lower for all components, including refrigeration, electrical wiring, etc. Also, smoothing of peak energy usage means electricity costs are lowered because of a smaller peak demand. Further, the system 2 can operate continuously, rather than in a start-stop mode, resulting in less maintenance and longer life for the machinery.

In the first step in the cyclic operation of system 2, i.e., freezing, the substance to be processed is sprayed into the vessel through nozzle 26 under pressure from the feed tank via line 28. Valve 32 is open to allow flow of the substance during the freezing step, and is closed at all other times. Valve 48 is a purge valve which is opened only briefly at the point when the freeze step is complete, allowing pressurized nitrogen to clear the nozzle 12, thus preventing it from freezing during subsequent steps.

The actual pressure of the liquid at nozzle 12 is preferably between 100 psi and 200 psi, though pressures either higher or lower could be used. At these pressures the droplet size for most substances will range between 50 and 500 microns, though some droplets will fall outside this range. Lower pressures will generally result in lower throughput rates and larger droplets; higher pressures will generally result in higher throughput rates and smaller droplets. However, higher pressures may also be required for very viscous substances or substances with some solids contained in the liquid. An example of the latter is a fruit juice concentrate, especially citrus concentrates.

The droplets are frozen in a stream of cold nitrogen gas entering the vessel through plenum 50 and supplied via conduit 56. Plenum 50 and entry port 52 to vessel 4 are so shaped as to direct the gas flow over the nozzle 26 and somewhat inward to contain the spray 14 and further aid in preventing it from reaching the vessel walls 24. The gas at this point has been chilled in heat exchanger 74 so that the droplets freeze almost instantaneously. For substances such as citrus juices, especially concentrates, a low freezing temperature is necessary to prevent stickiness due to unfrozen components on the surface of the droplets. Empirically, such materials need to be frozen to at least −26° C. (−15° F.) and preferably to −30° C. (−22° F.), or even colder. The temperature of the frozen particles can be regulated by adjustment of several different variables: 1.) the rate of product flow through nozzle 26; 2.) the temperature of the material at the nozzle 26; 3.) the rate of flow of the nitrogen gas; and 4.) the temperature of the nitrogen gas. While citrus concentrates require low temperatures, other substances may be processed at higher temperatures. For a typical operation of the system, the nitrogen gas would enter the vessel at approximately −60° C. (−76° F.), and would be warmed by the product during freezing to the aforementioned −30° C.

The frozen droplets 20 fall to portion 8 of vessel 4, building up in a bed. This bed is agitated slightly during the freeze step by a small flow of gas through conduit 64 into plenum 70, where it is directed through the bed via nozzles 86.

In another embodiment, the flow of gas through the bed of particles may be accomplished by directing the flow of gas from plenum 70 through a screen or fine grid in place of the nozzles 86. However, the nozzles provide the preferred embodiment for reasons which will be described subsequently. This gas is at the same temperature as the gas entering the top of the vessel 4 via plenum 50, having passed through the same heat exchanger 74. The ratio of the gas flow between the top of the vessel and the bottom of the vessel is controlled via proportioning valve 68. The gas flowing through the bed will maintain it in a fluidized state, thus preventing the particles from sticking together or agglomerating. The temperature of this gas in the example is −60° C., so that as the freezing step progresses the particles in the bed at the bottom of the vessel will continue to be cooled. Some products could be damaged by excessively cold temperatures, so in these cases the bottom gas flow would be reduced to a slower rate.

An additional purpose of the gas flow into the bottom portion 8 of vessel 4 is to provide a cushion of gas to effectively brake the flow of gas and droplets from above. This will allow higher nozzle and top gas flows than would otherwise be the case, thus increasing capacity.

The nitrogen gas entering the vessel through both the top and bottom exits vessel 4 via openings 61, plenum 60 and conduit 58. The plenum 60 and openings 60 into the vessel are constructed in such a way that the gas flow is up along the wall 24 of vessel 4 before exiting it. This flow assures intimate contact of the gas with the interior walls 24 of vessel 4 for reasons described later.

As shown, the separate flows of gas into the top and bottom of vessel 4 are independently controllable. This allows greater flexibility of operation and adjustment to different conditions and materials than if there were a single inlet and outlet.

After exiting the vessel, the gas flows into cyclone separator 62, which creates a vortex to separate any entrained particles from the gas flow. The particles fall via conduit 76 back into the bottom portion 8 of vessel 4. The gas flows onward to turbine or blower 72, which provides and controls the gas flow rate through the system 2. The gas then flows across heat exchanger 74 and is once again recirculated through system 2.

During this freezing step the vessel 4 is cooled to the same temperature as the incoming gas, i.e. −60° C. in this example. This cooling is accomplished by chilling coils 88 which may, advantageously, be equipped with fins to provide additional contact surface. However, the preferred embodiment is that the interior of the vessel be relatively free of obstructions or excessive protuberances to prevent any possible sticking of product to the interior surface of the vessel and, also, to facilitate cleaning during the defrost cycle. The cold temperature of the walls 24 of vessel 4 discourages particles from sticking thereto.

An additional purpose of the cold interior walls is to condense out any water vapor which is evaporated during the freezing step. The primary step for removal of moisture is the drying step, so further discussion of aspects of vapor condensation on the interior vessel wall will be deferred to description of that step.

Both the heat exchanger 74 and cooling coils 88 are supplied with cold via a heat-transfer liquid pumped from the cold tank 40 via lines 132 and 136.

The duration of the freezing step is governed by the following considerations: 1.) the longer the cycle, the more product can be obtained in a single cycle; 2.) the depth of the bed should not be so great that maintenance of a fluid bed condition is impaired; 3.) the amount of water to be removed must be in balance with the temperature and area of the interior wall to avoid excessive buildup of snow or ice which would limit effective operation, possibly before the product is dry. In the present example, the duration of the freeze step is 45 minutes and the depth of the resultant bed is several inches.

At the conclusion of the freezing step, the bed of frozen particles 20 at the bottom of vessel 4 is ready for drying. As mentioned earlier, some drying has already taken place during the freezing step, but the primary removal of water takes place during this step. To accomplish drying, heat must be supplied to the frozen particles to provide the necessary energy to sublime ice into water vapor. Also, the gas must be dried to provide the necessary differential vapor pressure to pull the vapor from the product. Ordinarily, these are the most energy-intensive elements of the freeze-drying process, but the present invention accomplishes them in a highly efficient manner to be detailed below.

To provide the required warm, dry gas flow, valve 68 is adjusted to close conduit 56, thereby directing all flow through conduit 64 into the bottom of vessel 4 and through the bed of particles 20. The gas flows across the heat exchanger 74 as before, but now the heat exchanger is warmed by connection to hot tank 102 by closing valve 118 and opening valve 126 thereby opening tank 102 to line 136. The warm gas which then flows from conduit 64 into vessel 4 sublimes water from the particles 20, which remain at their colder temperature as long as water is still changing state from ice to vapor.

The exact temperature and flow rate of the gas during the drying step are variable within a wide range, but are governed by the following conditions: 1.) the higher the temperature and flow rate, the faster the product will be dried; 2.) if the temperature/flow rate combination is too high, the particles will be warmed excessively, possibly melting or reaching a point of stickiness; 3.) the rate of water removal from the product must be in balance with the rate of removal of the water from the gas, or the gas will not be capable of drying efficiently. In the present example, the gas will be heated to between −10° C. and 30° C. (14° F. and 86° F.). The product will reach a temperature no higher than −26° C., having been previously cooled to between −30° C. and −60° C.

After passing through the bed, the now-wet gas will pass upward and contact the interior walls 24 and coils 88 of vessel 4. During this drying step, the interior cooling coils 88 will continue to be connected to cold tank 40 at −60° C. The water vapor carried in the nitrogen gas will therefore see a temperature differential of more than 30° C. (54° F.), corresponding to a vapor pressure differential of more than 400 microns. It is this pressure/temperature differential which drives the sublimation process and removal of the sublimed vapor by condensation.

As previously described, the design of the openings 61 helps to direct the gas across the interior walls 24 of vessel 4. Also, the shape and angle of the nozzles 86 cause a circulation of the gas which encourages contact with vessel side wall 24. This effect must not be exaggerated, however, lest the gas set up an interior vortex which entrains excessive amounts of product, either causing it to contact and stick to the wall or to escape in the departing gas flow. Though such escaping particles would generally be returned to the vessel via cyclone separator 62, good practice would be to avoid entrainment as much as possible in the first place.

In contact with the cold vessel wall 24, the water vapor removed from the product will be condensed as snow or ice upon the wall. This accomplishes the necessary drying of the nitrogen gas, which then recirculates through the heat exchanger 74 to be warmed and once again enter the bottom of vessel 4 as warm dry gas. As drying proceeds, the conditions of the gas flow may be altered, for example, by changing the temperature or flow rate if needed to obtain desired results such as maintenance of product quality, drying rate, product internal temperatures, and/or reduced entrainment of dry particles. The measurements needed to make these adjustments are obtained from probes and sensors (not shown) located in various parts of the system. An overall control system is discussed subsequently.

In the example, concentrated orange juice is freeze-dried in system 2. Frozen concentrated orange juice (FCOJ) is normally produced by evaporation to 65° Brix (65% solids and 35% water). At this level, the concentrate contains less than 10% of the water contained in whole (single strength) juice. In the prior art freeze-drying operations with FCOJ, concentrates were limited to about 25° Brix (25% solids, 75% water), if they could be processed at all. By comparison, 65% concentrate contains less than 20% of the water contained in 25% concentrate. Even higher concentrates are possible, but may require special evaporative processing which may begin to lower the quality.

Since removal of water by evaporation (concentration) is significantly cheaper than removal of water by freeze-drying, the ability to start with a highly concentrated feedstock increases the throughput, reduces the energy consumption, and therefore greatly improves the economics of the drying step. In a sense, the operation of the invention can be seen as the final stage in a process that begins with single-strength juice, proceeds through concentration, and ends with spray-freeze-drying to produce a high-quality dry product in the most efficient possible way.

In the example, starting with 65% FCOJ, the drying step requires approximately 90 minutes to complete. At this point the product is in finished form and is ready for removal from the system and packaging. The dry powder is removed via valve 140 which allows the product 141 to flow into canister 142, attached to the nipple 143 that depends from central opening 144 in bottom wall 145 of vessel 4 by airtight lock 146. In an alternate embodiment (not shown), the canister 142 is replaced by a conduit which allows pumping of the product directly to a packaging machine (not shown) without breaking the gas seal.

In addition to directing the gas flow during the drying step, the nozzles 86 play a role in product removal. The nozzles 86 are angled slightly toward the center of vessel 4, so that as product 141 is removed, the final vestiges are moved toward the canister opening 148 by action of the gas flow through nozzles 86. Gas flow at this terminal point may be either increased or decreased as required to accomplish complete product removal.

An important benefit of the new systems of the invention is that all processing, including final packaging, takes place in an inert atmosphere. As a substance is freeze-dried, the pores vacated by water must be filled with some other material or kept empty by strict maintenance of a vacuum until the product is used. In the example, nitrogen gas automatically fills the pores. Hence, as long as packaging is accomplished without breaking the gas seal, the product will never encounter oxygen or water vapor until the time of use. In other systems, this achievement is difficult, and since freeze-dried juices are extremely hygroscopic, the smallest exposure to water will cause problems. These same characteristics of open pores and high attraction to water also account for the easy reconstituting of the fruit juices dried in accordance with the invention, i.e., the added water is absorbed quickly and completely with none of the clumping and surface effects encountered with many dry powders.

After the dry product has been removed from the vessel 4, the system is defrosted to remove the ice and snow built up during drying. Most of this accumulation, e.g., 60 to 90% and particularly 70 to 85%, will be on the interior walls 24 of vessel 4, but some, e.g., 10 to 40% and particularly 15 to 30%, will have exited vessel 4 and condensed on heat exchanger 74, and even to some extent on interior surfaces of conduits 56 and 58 and the cyclone separator 62.

Most of the heat for defrosting is supplied from hot tank 102, through some is also supplied by hot water heater 106.

Heat-exchange fluid from the hot storage tank is pumped through the interior coils 88 of the vessel 4 via valve 124 and piping 132, melting the condensate frozen thereto (not shown). The heat exchanger 74 is also connected to the hot tank 102 via valve 126 and piping 136, so the recirculating gas carries heat throughout system 4. Valve 68 is set at an intermediate point, allowing gas to circulate in conduits 56 and 64 equally. To assist in melting ice in vessel 4, and also to provide a final cleansing, hot water may be pumped from hot water heater 106 via pump 112 and line 110 through nozzles 108 which are positioned to direct spray on all parts of vessel interior 16. At the end of the defrost step, nozzles 108 will be purged by pressurized gas through valve 150 to prevent freezing when the cycle repeats.

Liquid melt water is removed via exit line 152 plus valve 154 and valve 140 (canister 144 was removed and has not yet been re-attached at this stage of operation). By the end of the defrost step, the entire system is warm and contains no liquid water.

When all water is removed from the system, it is ready to be reset in preparation for a new cycle beginning with the freezing step. Depending on the material being processed, the nitrogen gas injected into the system previously may have become contaminated with oxygen or non-condensible vapors. If so, the system will need to be purged and refilled with nitrogen. In any case, purging is needed at initial start up of the system 4.

Purging takes place via vacuum purge pump 156 through valve 158. After emptying out the ambient gas in system 4, it is refilled with the processing gas through valve 160 and line 162 which connects to a supply of the gas (not shown). Depending on the purity of the gas needed in the system, the mechanical structure, and the capacity of purge pump 156, this purging step may be done in a single stage or in multiple stages. An example of multiple stages would be to draw the pressure in vessel 4 down to 20% of atmospheric, fill with nitrogen, and then repeat a second time, thus effectively reducing ambient contents to 4% of their original level. As mentioned, the system will be pressurized to slightly above atmospheric pressure to effectively exclude outside oxygen and water, if it is not perfectly gas-tight.

When the quantity of nitrogen or equivalent carrier gas has reached the required level in system 2, it is then cooled to the operating temperatures needed to restart the cycle. Cold fluid from cold tank 40 is circulated through vessel coils 88 and through heat exchanger 74. Product canister 144 is reattached. When proper conditions have been reached, the freeze cycle is started with the spraying of liquid feed once again through nozzle 26.

Various other arrangements (not shown) can be used to circulate heat exchange fluid within the process vessel of the invention. These may include serpentines, plate and coil arrangements, coils located on standoffs, or other arrangements.

Figure 4:
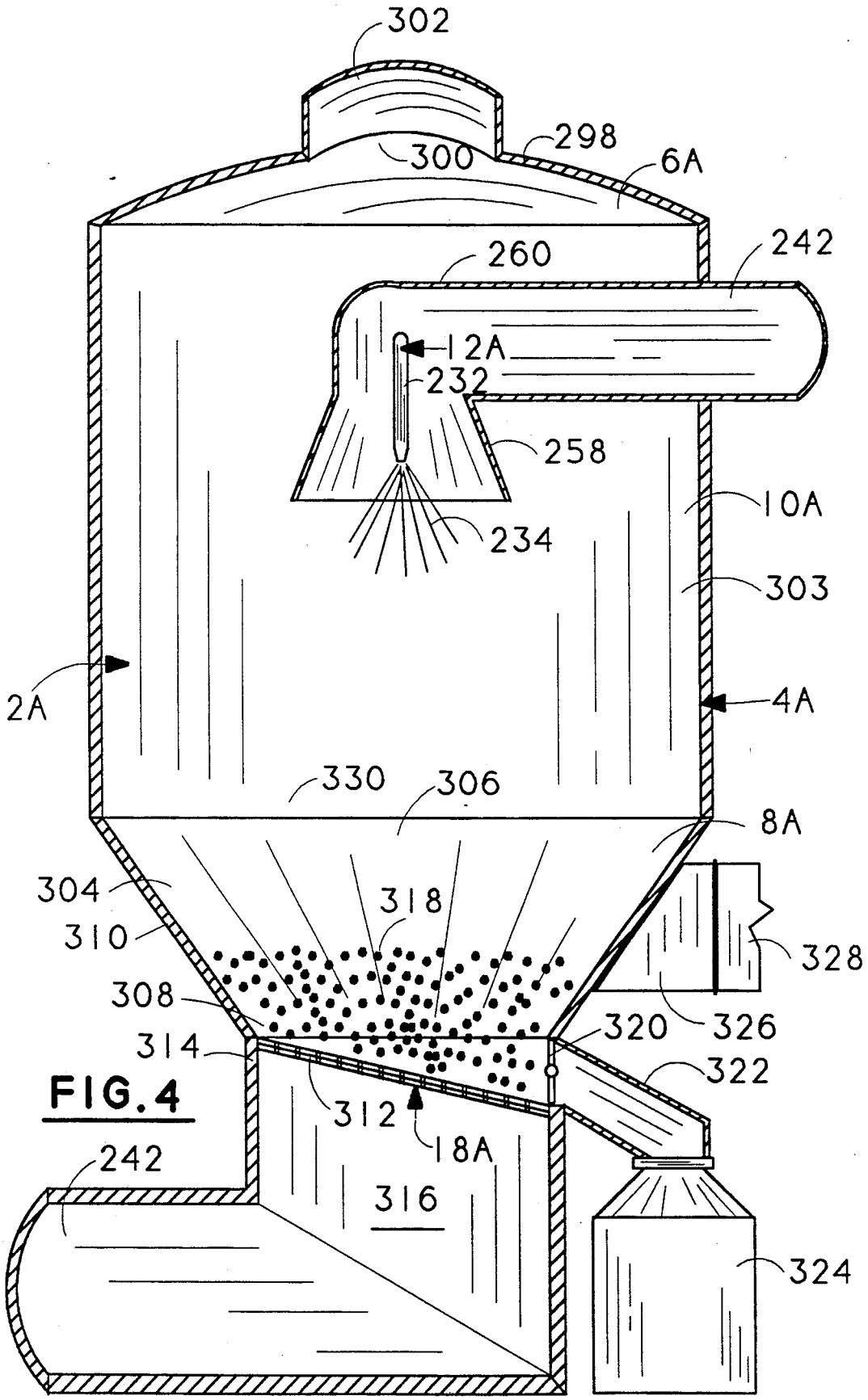
FIG. 4 is a lateral, sectional view of a second embodiment of a processing vessel in accordance with the invention.
Figure 5:
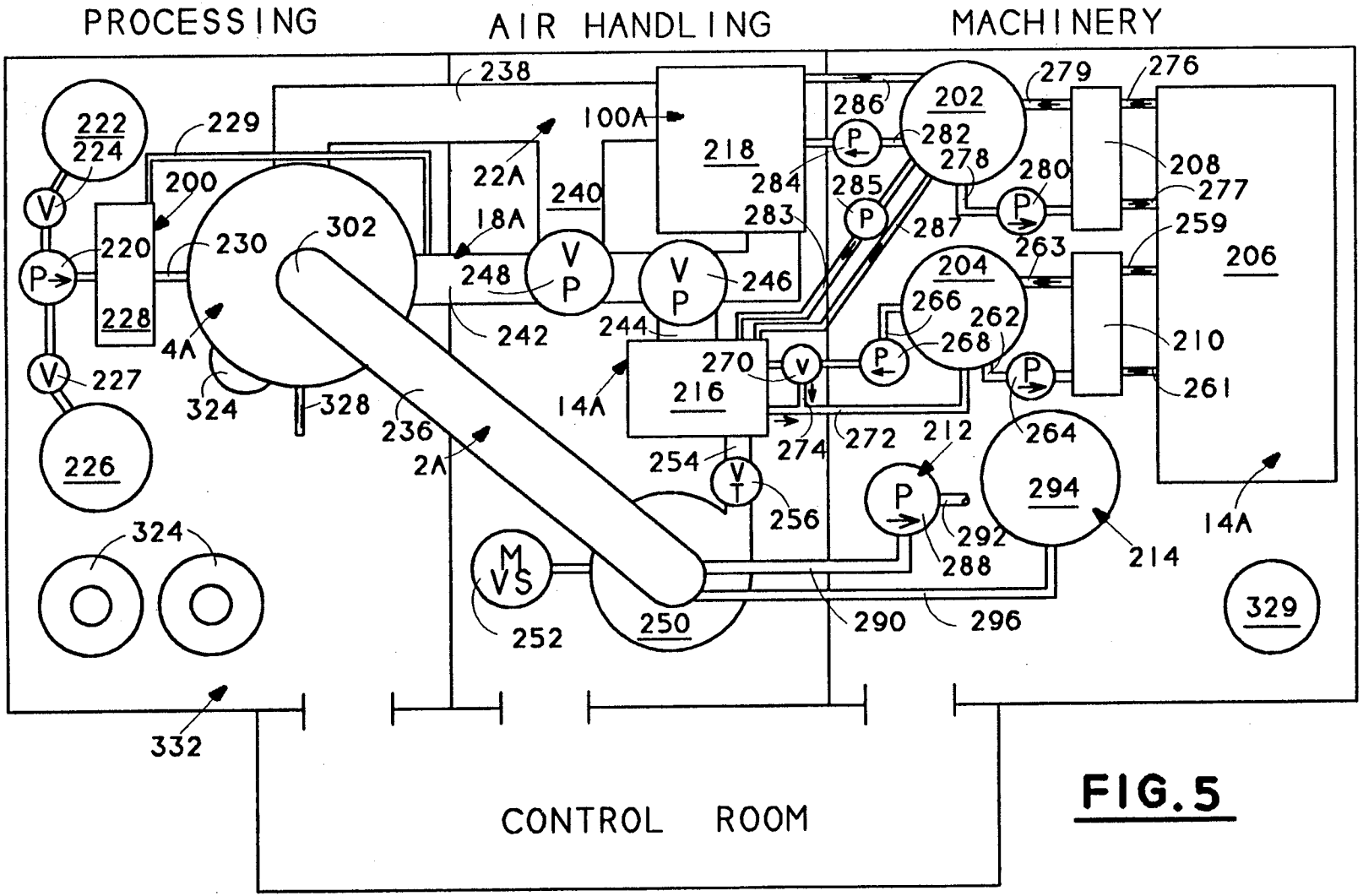
FIG. 5 is a diagrammatic plan view of a second embodiment of a SFD system of the invention comprising the processing vessel of FIG. 4.

Referring now to FIGS. 4 and 5, the FSD processing system 2A comprises a thermally insulated, processing vessel 4A that varies in some substantial ways from vessel 4 while still utilizing the same basic improvements of the invention over related freeze drying systems and methods known in the prior art. Thus, like vessel 4, vessel 4A comprises a top portion 6A, bottom portion 8A, central portion 10A and atomizing means 12A, but these differ substantially from their system 2 counterparts. Also, like system 2, system 2A comprises differently configured cooling means 14A, particle fluidization means 18A, gas circulation means 22A and heating means 100A. In system 2A, like system 2, all related pipes, valves conduits and other components are well insulated with insulation (not shown).

As seen in FIG. 5, basic components of system 2A, other than the means mentioned above, include feed spray system 200, hot tank 202, cold tank 204, heat pump 206, hot heat exchanger 208, cold heat exchanger 210, purge means 212, nitrogen gas source 214, ice condenser (cooling means) 216 and reheater unit (heating means) 218.

Relating these basic components to system 2A, feed spray system 200 includes a feed pump 220 that draws feed stock from tank 222 via valve 224 and/or from tank 226 via valve 227 to pass through meter pump device 228, line 229 to supply device 228 with a source of cold air and pipe 230 to convey material from device 228 to spray nozzle 232 producing source material spray 234.

Gas circulation means 22A comprises (A) first conduit 236, (B) second conduit 238 with Tee portion 240, (C) third conduit 242 that includes Tee portion 244 plus proportioning valves 246 and 248 and (D) high volume gas pump 250 that is driven by variable speed motor 252 to circulate gas in means 22A via its discharge conduit 254 under control of throttle valve 256.

Atomizing means 12A comprises the feed spray system 200, spray nozzle 232 and canopy 258 carried on exit end 260 of conduit 242.

Cooling means 14A comprises heat pump 206, cold heat exchanger 210, cold tank 204 and ice condenser 216. Exchanger 210 connects to the cold side of heat pump 206 via inlet line 259 and outlet line 261. Cold tank 204 connects (a) to exchanger 210 via lines 262 and 263 plus pump 264 and (b) to ice condenser 216 via outlet line 266 containing pump 268 and by-pass valve 270 plus return line 272 that includes by-pass line 274.

Heating means 100A comprises (1) hot heat exchanger 208 connected to the hot side of heat pump 206 via lines 276 and 277, (2) hot tank 202 connected to exchanger 208 via lines 278 and 279 plus pump 280 and (3) reheater unit 218 connected to tank 202 via inlet line 282 including pump 284 and return line 286. Hot tank also connects to ice condenser 216 via output line 283, pump 285 and return line 287.

The use of heat exchangers 208 and 210, while preferred for purposes of repair and maintenance, may be eliminated. In such modification, tanks 202 and 204 can contain internal heat exchange coils and lines 276, 277, 259 and 261 would be eliminated and replaced with lines 279, 278, 263 and 262 respectively.

Purge means 212 comprises purge pump 288 connected into gas circulation means 22A by line 290 and having exhaust line 292 to discharge gas purged from system 2A to ambient.

Nitrogen source 214 includes pressure tank 294 which connects to gas circulation means 22A by line 296.

Referring to FIG. 4, the top portion 6A of vessel 4A is defined by a domed top having central opening 300 to which the inlet end 302 of first conduit 236 is connected and the central portion 10A is a cylinder 303 though which the conduit 242 and the pipe 230 extend. Unlike vessel 4, the central portion 10A contains no internal coils.

The bottom portion 8A is a truncated conical unit 304 defined by an upper end 306, a lower end 308 and side 310.

The particle fluidization means 18A comprises the inclined grid 312 fitted in the upper end 314 of vertical extension 316 of conduit 242. Gas passing upwardly in extension 316 and through grid 312 fluidizes the particles 318 that form in vessel 4A from the spray 234. When particles 318 have dried, the particles are removed from vessel 4A by opening the valve 320 to allow the particles 318 to flow down the chute 322 into canister 324.

Unit 304 of vessel 4A is formed separate of cylinder 303 and extension 316 and is supported by arm 326 and attached to hinge 328 which is attached to a fixed vertical support (not shown). This arrangement permits unit 304 to be swing away from the rest of vessel 4A to permit unit 304 and the inside of vessel 4A to be accessed for cleaning, e.g., by a wand sprayer (not shown). A stream generator 329 is included as part of the machinery to provide steam used in such a cleaning operation. Plumbing associated with generator 329 is not shown.

Suitable sealing means (not shown) is used to from a gas tight connection between the lower end 308 of unit 304 and upper end 314 of extension 316 and between upper end 306 of unit 304 and lower end 330 of cylinder 303 when unit 304 is positioned for operation of system 2A as shown in FIG. 4.

In a typical system 2A plant, the building 329 housing it is divided into four sections, i.e., processing, air handling, machinery and control room sections. This arrangement enables clean maintenance of the processing section to ensure product quality and noise abatement in the air handling section.

The operation of system 2A is basically similar to the operation of system 2 as described in detail above. However, there are some differences so a brief discussion of system 2A operation is presented below.

In processing system 2A, the basic sequence of spray-freezing, drying, defrosting, and resetting is the same as in system 2. During the spray-freezing step, the product is sprayed through nozzle 232 located in the interior of vessel 4A and supplied by pipe 230 through the side of vessel 4A. The freezing gas is supplied by conduit 242, arranged to form a hood or canopy 258 directed downward and surrounding the nozzle 232. During the freezing operation, an amount of gas also flows upward through a fluidized bed of the frozen particles 318. The gas exits through central opening 300 in the top of the vessel 4A above the spray nozzle 232 and canopy 258 and is then cooled in ice condenser 216 external to the processing vessel 4A.

When spraying is complete, the drying cycle begins. Heat for drying is supplied through reheater unit 218 which warms the process gas. The warmed gas flows through conduit 242, extension 316 and grid 312 and thence upwards through the particles 318 at a velocity to form a fluidized bed. The bed is supported by the inclined screen or grid 312 at the lower (smaller) end of a conical section 310 in the bottom portion 8A of the vessel 4A. As the volume of space above the grid 312 expands, the velocity of the gas drops so that the particles remain in a defined area and are not entrained in the upward flowing gas. As the gas flows through the fluidized bed, water vapor is sublimed and carried away by the process gas.

The flow of vapor and gas exits vessel 4A at the top via conduit 236 and is propelled by blower 250 to the external ice condenser 216. The ice condenser 216 is at a temperature below both the particles 218 and the sublimed vapor; consequently, the vapor freezes back to ice and is removed from the flowing gas. The gas thus dried flows once again through reheater 218 and thence to vessel 4A in a continuous cycle.

When the product is dry, it is removed into product canister 324 mounted below and to the side of grid 312. The inclination of the grid 312 supporting the particles 318 causes the dry product to flow to the side of the vessel 4A where valve 320 is opened to allow the product to flow through chute 322 into canister 324.

Without opening the main system, the ice condenser 216 is then defrosted to remove accumulated ice and snow. Defrosting is accomplished by pumping hot fluid from hot tank 202 via line 283 through internal coils (not shown) in the ice condenser 216. The melt water is removed via a valve and pipe (not shown) in the bottom of the ice condenser 216. Since the entire system 2A is not opened during defrosting, the internal atmosphere of process gas is maintained. Therefore, purging and refilling are not needed after each cycle, but only when the system 2A is opened for some other reason.

One reason for opening system 2A is for periodic cleaning. In system 2A, the conical unit 310 is swung open on support 326 to expose the interior for cleaning by a manual steam cleaning system (not shown). In the equivalent system 2, the steam cleaning nozzles are built into the interior of the vessel, since it cannot be opened as easily. (However, it is also possible to have integral cleaning nozzles (not shown) in system 2A, thus providing a clean-in-place capability.)

The removal of cooling and ice-condensing coils 88 from the interior wall 24 of the vessel 4 in system 2 to an external unit in system 2A leads to a number of differences in structure. In system 2 fluidized bed product particles was formed by directed nozzles 86, which created a swirling upward motion of the gas and particles. This caused the gas stream to intimately contact the walls 24 of vessel 4. To maintain such contact, the exit plenum 60 was arranged around the periphery of the vessel top 54. In system 2A, such contact with the vessel sides is not needed, so the nozzles can be replaced by the inclined grid 312 and the gas exit is a simpler opening 300 in the top 298 of vessel 4A. In system 2A, the conical section 310 reduces gas velocity sufficiently to eliminate the need for the external cyclone separator 62, though it could still be used when processing very fine or light particles.

The defrost and reset cycles are simplified in system 2A as well. Because ice is formed external to the processing vessel 4A, very little moisture will be found in vessel 4A, shortening the time to reset and dry the system in preparation for the next cycle.

While there are differences between the two embodiments, both have advantages. Either one or the other, or a combination of the two (not shown), could be used to dry materials with appropriate characteristics.

The invention has been shown and described with reference to single nozzles 26 and 232, but a plurality of nozzles (not shown) can be used, e.g., where greater throughput with close control of spray particle size can be better obtained with two or more nozzles, rather than with a single nozzle.

One of the advantages of the new systems and methods of the invention are their high degree of flexibility. Achieving this flexibility in practice requires means (not shown) of measurement and control for all process variables. A preferred embodiment of the invention includes sophisticated sensors and actuators controlled electronically by means of a Programmable Logic Controller (PLC). Temperatures, gas flows, pressures, valve settings, etc. can be programmed for different products and stored for later use. As each product is selected, the required logic is loaded and the process controlled accordingly until the cycle is reset for another product. Within a particular cycle, instrumentation measures progress and allows adjustment in real time via electrically-controlled actuators.

I claim:

1. In a system for the spray-freeze-drying of a fluid substance having a substantial content of solids dissolved in a liquid that includes a vertically elongated vessel having top, bottom and central portions, atomizing means including a nozzle positioned centrally in said vessel adjacent said top portion to deliver atomized particles of said fluid substance into said vessel, fluidizing means in said bottom portion to fluidize particles of frozen product formed in said vessel by upward flow of process gas into said vessel including a bottom opening in said bottom portion, cooling means to cool gas circulating in said system, heating means to heat gas circulating in said system and gas circulation means for introducing and withdrawing process gas into and from said vessel, the improvement which comprises:

a top opening in said top portion of said vessel, said gas circulation means comprising conduit means connecting said top opening to said bottom opening, pump means associated with said conduit means to move said process gas thorough said conduit means, a heat pump including a hot side and a cold side, a hot tank connected to said hot side, a cold tank connected to said cold side, first plumbing means connecting said hot tank to said heating means for circulation of heat exchange fluid between said hot tank and said heating means, and second plumbing means connecting said cold tank to said cooling means for circulation of heat exchange fluid between said cold tank and said cooling means.

2. The system of claim 1 wherein said conduit means includes a first conduit connecting said top opening to said pump means and a second conduit serving to connect said bottom opening to said pump means.

3. The system of claim 1 wherein said atomizing means comprises a canopy surrounding said nozzle.

4. The system of claim 3 wherein said conduit means includes a third conduit which enters into said vessel through a wall thereof and connects to said canopy to flow a portion of said process gas around said nozzle.

5. The system of claim 4 wherein said conduit means further comprises at least one proportioning valve.

6. The system of claim 5 wherein said proportioning valve controls flow of process gas through said third conduit.

7. The system of claim 6 wherein said conduit means passes process gas through said heating means and said heating means is positioned downstream of said pump means.

8. The system of claim 7 wherein said conduit means passes process gas through said cooling means and said cooling means is positioned downstream of said pump means.

9. The system of claim 1 which further comprises means to deliver said fluid substance in cooled condition and under pressure to said atomizing means nozzle.

10. The system of claim 1 wherein said fluidizing means further comprises a grid positioned in said conduit means below said bottom opening at an angle relative to the horizontal creating a higher portion and a lower portion in said grid.

11. The system of claim 10 wherein discharge means having an upper end and a lower end is associated with said grid to receive particulate material discharged from said lower portion of said grid into said upper end.

12. The system of claim 11 wherein flow of particulate material into said discharge means is controlled by a value positioned at said upper end of said discharge means.

13. The system of claim 12 which further comprises a canister for connection to said lower end of said discharge means.

14. The system of claim 1 wherein said bottom portion of said vessel is separable from said central and top portions permitting said vessel to be accessed for internal cleaning of said vessel by external cleansing equipment.

15. In a system for the spray-freeze-drying of a fluid substance having a substantial content of solids dissolved in a liquid that includes a vertically elongated vessel having top, bottom and central portions, atomizing means including a nozzle positioned centrally in said vessel adjacent said top portion to deliver atomized particles of said fluid substance into said vessel, fluidizing means in said bottom portion to fluidize particles of frozen product formed in said vessel by upward flow of process gas into said vessel including a bottom opening in said bottom portion, cooling means to cool gas circulating in said system, heating means to heat gas circulating in said system and gas circulation means for introducing and withdrawing process gas into and from said vessel, the improvement which comprises:

a top opening in said top portion of said vessel, process gas flow control means to cause a portion of said process gas to pass downwardly in said vessel around said nozzle conduit means to remove process gas from said top opening and convey a first portion thereof to said bottom opening and a second portion thereof to said flow control means, and valve means associated with said conduit means to vary the volumes of said first and second portions of said process gas.

16. The system of claim 15 wherein said flow control means comprises a canopy surrounding said nozzle.

17. In a method for the spray-freeze-drying of a fluid substance having a substantial content of solids dissolved in a liquid in a processing system including the steps of (a) spraying said fluid substance as a downwardly projected spray into a vertically elongated zone defined by boundary walls and including a top, central and bottom portions, (b) freezing said atomized particles by contact with chilled gas circulated within said zone, (c) fluidizing a bed of said frozen particles within said bottom portion by upward passage of gas through said bed, (d) drying said frozen particles in said fluidized bed by subliming said liquid therefrom to produce dried particles consisting essentially of said solids content and (e) removing said dried particles from said zone, the improvement which comprises:

maintaining said system at essentially atmospheric pressure throughout the course of said method, exhausting gas from said top portion of said zone throughout the course of said method, injecting gas into said bottom portion of said zone throughout the course of said method, and during said spraying step, surrounding said projected spray with a downwardly flow of gas.

18. The method of claim 17 which includes the additional steps of:

collecting a major portion of said sublimed liquid as frozen liquid within said system, and after said drying step and said dried particles removing step, defrosting said system by passing gas through said system having a temperature sufficiently high to melt said frozen liquid into melt liquid.

19. The method of claim 18 which further comprises removing said melt liquid from said system.

20. The method of claim 19 wherein, following said removal of said melt liquid, said zone is purged by drawing a vacuum thereon and refilling it with dry process gas.

21. The method of claim 17 wherein the flow rate $F_P$ of said fluid substance relative to said downwardly flow of gas $F_G$ around said downwardly projected spray is controlled according to the following equations:

$$Q_P = Q_G$$

where $Q_P = F_P(H_{VP}\Delta T_P + H_{FP})$ $$Q_G = F_G(H_{VG})\Delta T_G$$

and

Q = heat flux (heat per unit time)

F = flow rate (volume per unit time)

$H_V$ = heat content per unit volume per degree $H_F$ = heat of fusion per unit volume $\Delta T$ = temperature change.

22. The method of claim 17 wherein said downwardly flow of gas ceases during said drying step.

23. The method of claim 17 wherein said fluid substance is precooled outside said zone before said spraying thereof.

24. The method of claim 17 wherein said gas exhausted from said top portion is contacted with a heat exchanger and then recycled back into said zone.

25. In a method for the spray-freeze-drying of a fluid substance having a substantial content of solids dissolved in a liquid including the steps of (a) spraying said fluid substance into a vertically elongated zone defined by boundary walls and including a top, central and bottom portions, (b) freezing sprayed particles of said fluid substance by contact with chilled process gas circulated within said zone, (c) fluidizing a bed of frozen particles of said substance within said bottom portion by upward passage of process gas through said bed, (d) drying said frozen particles in said fluidized bed at essentially atmospheric pressure by subliming said liquid therefrom to produce dried particles consisting essentially of said solids content and (e) removing said dried particles from said zone, the improvement which comprises:

providing a first quantity and a second quantity of heat exchange liquid, withdrawing heat from said first quantity to reduce the temperature thereof to below the freezing point of said substance, heating said second quantity at least partially with heat withdrawn from said first quantity, during said freezing step, using said first quantity to chill said process gas and said zone and during said drying step, using said second quantity to heat said process gas.

26. The method of claim 25 wherein further during said drying step said first quantity is used to cool a portion of said zone.

27. The method of claim 25 wherein a heat pump is used to withdraw heat from said first quantity and to heat said second quantity.

* * * * *